United States Patent [19]

Montgomery

[11] Patent Number: 4,548,331

[45] Date of Patent: Oct. 22, 1985

[54] CHILD RESISTANT DISPENSING CLOSURE

[75] Inventor: Gary V. Montgomery, Evansville, Ind.

[73] Assignee: Sunbeam Plastics Corporation, Evansville, Ind.

[21] Appl. No.: 673,012

[22] Filed: Nov. 19, 1984

[51] Int. Cl.[4] ..... B65D 51/18

[52] U.S. Cl. ..... 220/253; 222/153

[58] Field of Search ..... 220/253, 326, 336; 222/153, 516, 548, 554, 480, 484, 485, 486; 215/235, 237

[56] References Cited

U.S. PATENT DOCUMENTS

| | | | |
|---|---|---|---|
| 3,486,665 | 12/1969 | La Croce | 220/253 |
| 4,164,301 | 8/1979 | Thayer | 220/253 |
| 4,203,527 | 5/1980 | La Chance, Sr. | 220/253 |
| 4,308,979 | 1/1982 | Otterson | 222/516 |

*Primary Examiner*—George T. Hall

*Attorney, Agent, or Firm*—Fisher, Crampton, Groh & McGuire

[57] ABSTRACT

A two piece safety or child resistant dispensing closure for granular or pellet material. The opening of the dispensing window can be varied to control the rate of dispensing. One piece of the closure is a cap which is attached to the container by threads or a snap-on flange. The cap has a pair of opposed circumferential windows in its top. The second piece of the closure is a flat cover with corresponding circumferential dispensing windows. The cover is attached to the cap for rotation between an aligned window dispensing position and a closed, nonaligned window position. A pair of opposed rocker arms which may be depressed by the thumb and forefinger of the user is used to release the cover from its closed position and rotate it to a dispensing position. Detents on the cap coact with the rocker arms on the cover to secure the cover and cap with any desired degree of alignment between the windows on the cap and cover to achieve metered dispensing.

18 Claims, 8 Drawing Figures

CHILD RESISTANT DISPENSING CLOSURE

This invention relates to a safety or child resistant closure, and more particularly to a two piece safety dispensing closure for granular or pellet materials.

There are a wide variety of child resistant or safety closures which require simultaneous or sequential motions to move from a closed to an open position, the combination of motions making it relatively difficult for children to open. Most of these closures are adpated for use on prescription tablet or capsule containers with a smaller number designed for use in dispensing liquids. While some safety closures could be adapted for use with powdered or granular material, I am not aware of a safety closure which allows adjustment of the dispensing opening to control the dispensing action.

It is therefore an object of this invention to provide a safety closure for granular or pellet type material.

Another object of this invention is to provide a safety closure for dispensing granular or pellet material in which the window opening can be adjusted to control the flow of material being dispensed.

It is still another object of the invention to provide a safety closure for dispensing granular or pellet material in which the window openings are retained in their preselected open positions regardless of the degree of opening.

The objects of this invention are accomplished by a two piece dispensing closure in which the first piece is a cylindrical cap having an annular skirt which contains means for attaching to a standard container. Usually the cap is either internally threaded to mate with external threads on the neck of the container, or typically coacting beads or flanges are formed on the interior of the cap and exterior of a container neck to provide a snap-on type of attachment. The top of the cap is provided with a pair of diametrically opposed circumferential slot windows through which the contents of the container are dispensed. These windows may be radially divided to break up the flow of product therethrough. The top of the cap is recessed to a depth to accommodate a flat cover which is affixed to the cap by a centrally projecting retaining boss which is snapped into a centrally located hole in the cap. The recess in the cap forms an annular guard around the cover to prevent gripping and rotation of the cover. A pair of diametrically opposed radially extending rocker arms occupy a portion of the cover between the windows. The rocker arms are normally molded with the cover and have a centrally located molded torsion hinge which acts as a spring to return the rocker arm to its as molded normal position. The rocker arm has a locking tab portion at its outer end which engages a retaining slot formed by axially extending posts molded integral with the inside of the annular guard. The rocker arms on the cover are so oriented with the posts forming the retaining slots on the cap that when the rocker arm engages the slots, the windows on the cap are out of registration with the windows on the cover providing a closed or sealed closure. The radially inward ends of the rocker arms consititute a pressopen area which can be engaged by the thumb and index finger of the user to depress the arms which disengages the locking tabs from the retaining slots so that the cover can be rotated from a first closed position where the windows of the cover and cap are out of dispensing registration with each other to a second dispensing position where the windows on the cover and cap are aligned to the extent desired by the user. In order to accommodate the press-open end of the rocker arm when it is depressed, an annular recess can be formed on the underside of the cap. Alternatively, the lid may be formed with upraised guards having an upwardly slanted portion to receive a corresponding sloping press-open portion of a bent rocker arm.

Once the press-open ends of the rocker arms have been depressed and the locking tabs released, the cover may be rotated so that any degree of overlap or alignment of the windows on the cap and cover can be obtained. This allows the user to meter the dispensing flow of product from the container. To enhance this selective feature, an annular array of detents is provided along the inside of the annular guard wall between the retaining slots. When the desired window opening is obtained and rotation is stopped, the locking tab ends of the rocker arm engage the detents to provide a positive stay-open feature. This may be further facilitated by providing a downwardly extending projection on the bottom of the locking tab for engagement with the detents. Downwardly sloping ramps are provided between the tops of the posts and the detents, so that when the cover is rotated to close the closure, the rocker arm locking tabs will ride up the ramps and over the tops of the posts to drop into retaining slots, thus again locking the cover to the cap.

The preferred embodiments of the invention are illustrated in the drawings in which.

Figure 1:
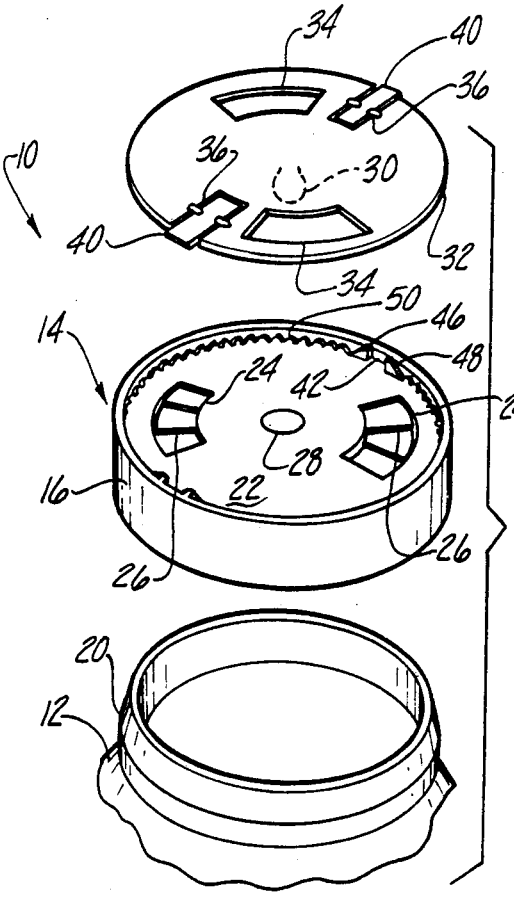
FIG. 1 is an exploded perspective view of the closure embodying the invention as applied to a conventional container.
Figure 2:
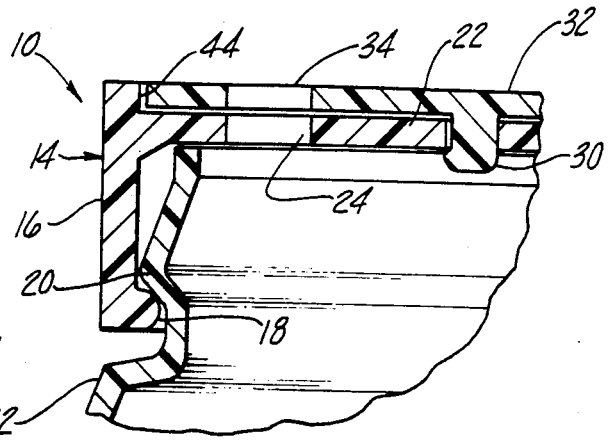
FIG. 2 is a fragmentary elevation view in cross-section showing the closure of FIG. 1 applied to a container with dispensing windows shown aligned.
Figure 3:
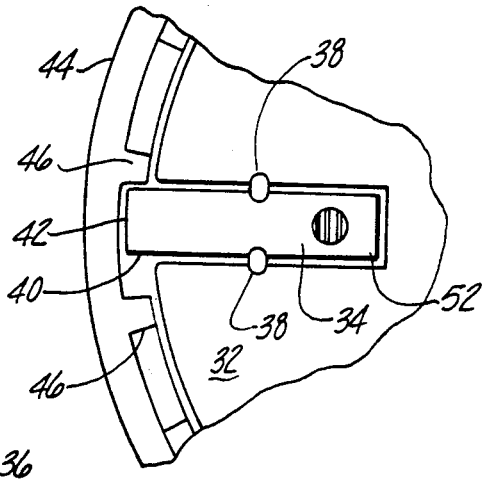
FIG. 3 is a fragmentary plan view of the closure of FIG. 1 showing one of the rocker arms in its locked, closed position.

Referring to FIGS. 1 through 4, a safety or child resistant closure 10 is shown as it is applied to container 12. Closure 10 is a two piece dispensing type closure which is adapted to be applied to a standard container with conventional fastening means. Closure 10 includes a cap 14 having a cylindrical body portion 16, the interior of which contains conventional fastening means such as screw threads or snap-on flanges or beads. As shown in FIG. 2, the interior of cylindrical cap body 16 has an annular undercut bead 18 at its lower end which coacts with neck finish bead 20 on container 12 to provide a snap-on type of fastening. Cap 14 has a recessed flat top 22 containing diametrically opposed circumferential window openings 24 through wich the product is dispensed. In some applications, only one such window 24 may be provided. Each of the windows 24 may be subdivided by radial partition members 26 which helps the user to consistently gauge the desired opening and also it provides a means to break up any lumps of a granular product which may have been formed by accidental wetting, for example, the product may be a granular chemical for swimming pool use. Cap top 22 is also provided with a centrally located aperture 28 to receive a coacting centrally projecting retaining boss 30 on disc shaped cover 32. Boss 30 snaps into aperture 28 to retain cover 32 for rotation relative to cap 14. The recess in cap 14 forms an annular guard 44 around the cover 32 to prevent gripping and rotation of the cover. Cover 32 contains two diametrically opposed circumferential slot windows 34 which are of the same size and radial location as cap windows 24 so that the cover may be rotated to provide complete registration of cover windows with cap windows 24 for maximum flow of product from the container 12.

Cover 32 is integrally formed with a pair of diametrically opposed, radially extending, rocker arms 36. Each rocker arm 36 pivots about a molded torsion hinge 38. The rocker arms could be molded as separate pieces, having, for example, integral hinge pins which would engage eyelets molded on cover 32. However, this is not as desirable as an integrally molded cover, rocker arm and torsion hinge assembly. With a molded torsion hinge, the rocker arm will return to its normal flat, as molded, position flush with the cover. The torsion hinge acts as a spring loading when the rocker arm is pivoted. The radially outward end of the rocker arm extends beyond the periphery of the cover 32 to form a locking tab portion 40 which is engageable with retaining slots 42 formed integrally with the inside of annular guard 44.

Retaining slots 42 are defined by circumferentially spaced posts 46 extending upwardly from recessed top 14 and formed with the inside of annular guard wall 44. On the side of each post 46, facing outward from the slot 42 is a ramp 48 which slopes downwardly away from the slot and top of the post to an annular array of detents 50 formed on the inside of annular guard 44 between the posts. The radially inner ends of rocker arms 36 constitute a "press to open" or a "press-open" area 52 which can be easily engaged by the thumb and index finger of the user to depress the rocker arms. This press-open area 52 may be identified by seriated dots 54, and in some instances, a legend may be applied to the cover such as "Push at dot on both tabs, then turn" as operating instructions to the user.

Figure 4:
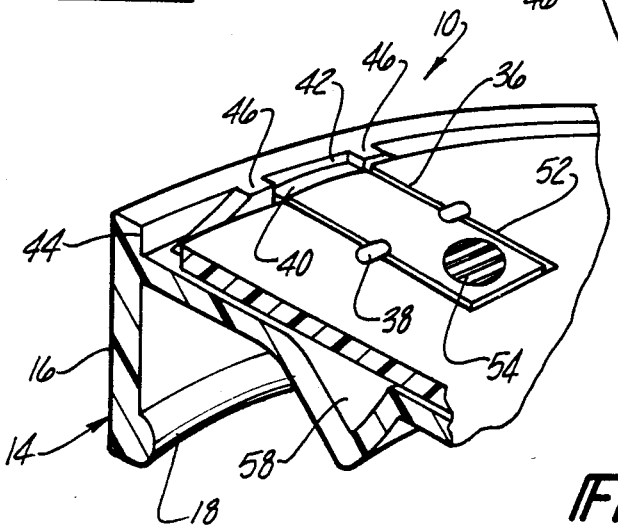
FIG. 4 is a fragmentary perspective view of the closure in the locked position of FIG. 3 showing the detail of the recessed area on the cover.
Figure 5:
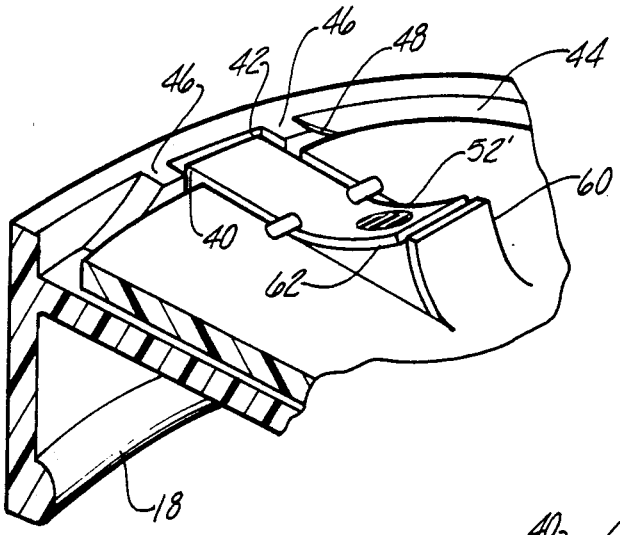
FIG. 5 is a fragmentary perspective view of another embodiment of the rocker arm, shown in its locked, closed position.
Figure 6:
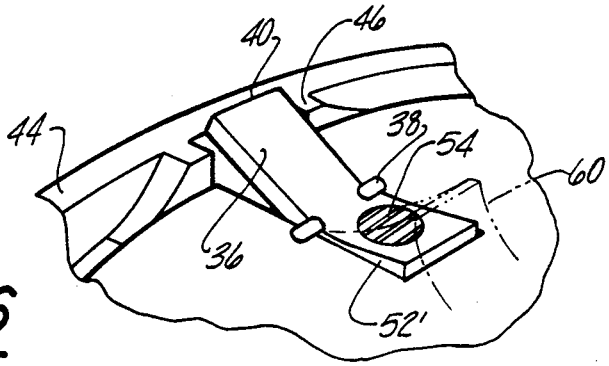
FIG. 6 is a fragmentary perspective view similar to FIG. 5 showing the rocker arm in its unlocked position with the rocker arm guard removed for clarity.
Figure 7:
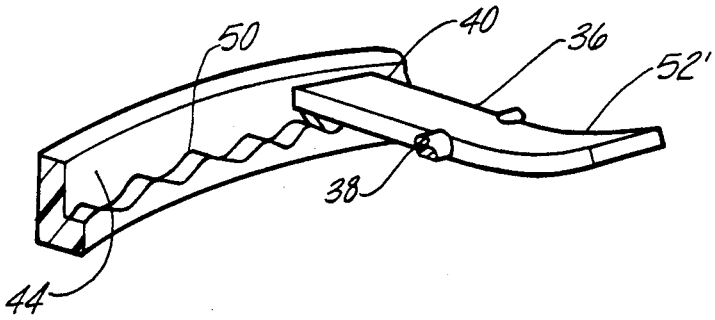
FIG. 7 is a fragmentary perspective view of the embodiment of FIG. 5 showing the coaction of the cap detents with a rocker arm for adjustment of the window opening.
Figure 8:
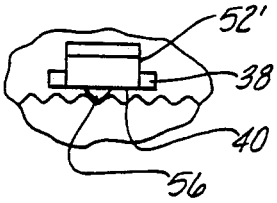
FIG. 8 is a fragmentary view showing the coaction of a projection on the end of a rocker arm with the detents.

In operation, locking tabs 40 are confined in retaining slots 42 in the closed position of cover 32. In this closed position, cap windows 24 are out of alignment or registration with cover windows 34 so that no product can be dispensed. The user unlocks the closure by depressing the press-open areas 52 of both rocker arms. This pivots the rocker arms about hinges 38, lifting the locking tabs from retaining slots 42 between posts 46. The cover can then be turned from the closed position to align the cover windows 34 with cap windows 24 to the extent desired by the user. For example, if the container 12 contains a swimming pool chemical which the user wishes to pour into a measuring cup, the user can turn the cover 32 to a dispensing position where the windows are in complete registration with each other. If, however, the user wishes to sprinkle or broadcast the chemical granules, the user could turn the cover to a dispensing position where there is only a small overlap of the windows. In either position, when the user releases the rocker arms 36, the sides of the locking tabs 40 will engage the detents 50 to hold the cover stationary—see FIG. 7. Optionally, the underside of locking tabs 40 can be provided with downwardly extending projections 56 which engage the detents 50 as shown in FIG. 8. In order to accommodate the press-open ends 52 of the rocker arms 36 when they are depressed to release locking tabs 40, and to rotate the cover to an open position, the lower side of cover 32 is provided with a circumferential recess 58 as shown in FIG. 4.

In the embodiments shown in FIGS. 5–8, the recess 58 is eliminated and the rocker arms 36' are sloped upwardly at their press-open ends 52' being surrounded by upraised guard 60 formed or molded integrally with cover 32. Guard 60 has a slanted portion 62 to receive the sloped press-open ends 52' of the rocker arm. All the other features of this embodiment remain the same as the first embodiment, and the user can unlock and rotate the cover by depressing the pressopen areas 52' with the thumb and index finger and exerting a turning twist. In both of the illustrated embodiments of the invention, the rocker arms are spaced circumferentially between the dispensing windows, but as best shown in FIG. 1, the rocker arms are not equally spaced between the windows because it is necessary to provide adequate circumferential spacing for the closed position when cover windows 34 are out of registration with cap windows 24. In this closed position, cap windows 24 are closed by an imperforate portion of cover 32 and cover windows 34 are closed by an imperforate portion of cap top 22.

The embodiments of the invention in which an exclusive property or privilege is claimed are defined as follows:

1. A two piece safety dispensing closure for a container comprising, in combination: a cylindrical cap having an annular skirt containing means for attachment to a container, and a flat top having a dispensing opening therethrough, a flat cover affixed to said cap for rotation relative thereto and having a dispensing opening therethrough, and a rocker arm occupying a portion of said cover and being pivotably connected thereto by a hinge, said rocker arm having a locking tab engageable with retaining means on said cap for locking said cover against rotation in a first closed position with said dispensing openings out of registration with each other, and upon depression of said rocker arm, said locking tab disengages said retaining means to permit rotation of said cover to a second dispensing position wherein said dispensing openings are aligned to form a passage for dispensing the contents of said container therethrough.

2. The two piece safety dispensing closure of claim 1 wherein said rocker arm is formed integral with said cover and the means for pivotably connecting said rocker arm to said cover is a molded torsion hinge.

3. The two piece safety dispensing closure of claim 1 wherein said cap is formed with its top being recessed to a depth approximating the thickness of said cover to thereby form an annular guard preventing rotation of the cover by gripping its outside edge, said retaining means on said cap including a pair of circumferentially spaced posts extending upwardly from said recessed top abuting the inside annular wall of said guard, and said rocker arm extending in a radial direction with said locking tab being retained between said posts for locking said cover in a first closed position against rotation.

4. The two piece safety dispensing closure of claim 3 wherein said cap is formed with an annular array of detents along the inside of said annular wall of said guard within the larger circumferential area between said posts whereby when said rocker arm is pivoted to release said cover from its first closed position, and said cover is rotated to align said dispensing openings to form a passage in said second position, said detents coact with said locking tab to permit alignment of said openings to a desired degree and to retain said cover in said second dispensing position.

5. The two piece safety dispensing closure of claim 4 wherein a downwardly extending projection is formed on said locking tab for engagement with said detents.

6. The two piece safety dispensing closure of claim 4 wherein ramps are formed on the sides of said posts facing away from each other, said ramps extending downwardly towards said detents whereby when said cover is rotated from said dispensing position towards said closed position said locking tab will be raised above said retaining posts to drop therebetween into said first closed position.

7. The two piece safety dispensing closure of claim 1 wherein said cover is formed with a centrally projecting retaining boss and said cap has a centrally located aperture to receive said boss as it is snapped into place to affix said cover for rotation relative to said cap.

8. The two piece safety dispensing closure of claim 1 wherein a rocker arm guard is formed integral with said cover, said guard having radial, upwardly slanted side walls to receive a portion of said rocker arm with a corresponding inclined press-open surface.

9. The two piece safety dispensing closure of claim 1 wherein said rocker arm is radially oriented with said locking tab being at its outer end, and the inner end presenting a press-open surface, said rocker arm being flush with the cover surface when said cover is in its first closed position, and said cap having an annular recessed area to receive the inner end of said rocker arm when it is depressed.

10. The two piece safety dispensing closure of claim 1 wherein said dispensing openings in the top of said cap and said cover are in the form of circumferential slot windows.

11. The two piece safety dispensing closure of claim 10 wherein said cap and cover each have two diametrically opposed dispensing windows.

12. The two piece safety dispensing closure of claim 11 having two diametrically opposed radially extending rocker arms spaced between said diametrically opposed dispensing windows.

13. A two piece safety dispensing closure for a container comprising, in combination: a cylindrical cap having an annular skirt containing means for attachment to a container, and a recessed top having a pair of diametrically opposed circumferential window openings, a flat cover affixed to said cap for rotation relative thereto, said cover having a pair of diametrically opposed circumferential window openings, radially located so that they can be aligned with the cap windows to form passages for dispensing the contents of said container therethrough, said cap being recessed to a depth approximating the thickness of said cover to thereby form an annular guard preventing rotation of said cover by gripping its outside edge, a pair of diametrically opposed radially disposed rocker arms spaced between said windows and being formed as a portion of said cover with mid point molded torsion hinges, the radially outward ends of said arms constituting locking tabs engageable with retaining slots formed on the inside of said annular guard for locking said cover against rotation in a first closed position with said windows of said cover and cap out of dispensing registration with each other, the radially inward ends of said arms constituting press-open areas, a circumferential recess formed in the underside of said cap to accommodate the press-open ends of said rocker arms when they are depressed to disengage the locking tabs from said retaining slots permitting rotation of said cover from said first closed position to a second dispensing position wherein said cap and cover windows are aligned.

14. The two piece safety dispensing closure of claim 13 wherein said retaining slots are defined by circumferentially spaced posts extending upwardly from said recessed top and having ramp surfaces sloping away from the slot side of said posts toward an annular array of detents formed on the inside of said annular guard between said posts, whereby said detents cooperate with said locking tab to retain said cover in said second dispensing position with a desired degree of alignment between the windows of said cap and cover to regulate the flow of contents from said container, said ramps raising said locking tabs to drop over said retaining posts into said slots as said cover is rotated to said second closed position.

15. The two piece safety dispensing closure of claim 14 wherein a downwardly extending projection is formed on the locking tabs for engagement with said detents.

16. A two piece safety dispensing closure for a container comprising, in combination: a cylindrical cap having an annular skirt containing means for attachment to a container, and a recessed top having a pair of diametrically opposed circumferential window openings, a flat cover affixed to said cap for rotation relative thereto having a pair of diametrically opposed circumferential window openings, radially located so that they can be aligned with the cap windows to form passages for dispensing the contents of said container therethrough, said cap being recessed to a depth approximating the thickness of said cover to thereby form an annular guard wall preventing rotation of said cover by gripping its outside edge, a pair of diametrically opposed radially disposed rocker arms and associated upraised guards spaced between said windows and being formed as a portion of said cover, each of said rocker arms having: a molded torsion hinge at its mid point, a radially outward locking tab engageable in its horizontal, flush with cover, position with retaining slots formed on the inside of said annular guard wall, a radially inward press-open surface sloping upwardly, each of said guards having an upwardly slanted portion to receive the sloping press-open surface of said rocker arm, whereby the press-open portion of said rocker arms can be engaged by the thumb and index finger of the user to depress the arms, disengaging said locking tabs so that said cover can be rotated from a first closed position in which the locking tabs are engaged with the retaining slots and said windows of said cover and cap are out of dispensing registration with each other, to a second dispensing position wherein said cap and cover windows are aligned.

17. The two piece safety dispensing closure of claim 16 wherein said retaining slots are defined by circumferential spaced posts extending upwardly from said recessed top, and further including ramp surfaces sloping away from the slot side of said post towards an annular array of detents formed on the inside of said annular guard between said posts, whereby said detents cooperate with said locking tab to retain said cover in said second dispensing position with a desired degree of alignment between the windows of said cap and cover to regulate the flow of contents from said container, said ramp raising said locking tabs to drop over said retaining posts into said slots as said cover is rotated to said first closed position.

18. The two piece safety dispensing closure of claim 17 wherein a downwardly extending projection is formed on each of said locking tabs for engagement with said detents.

* * * * *